United States Patent [19]

Melanson et al.

[11] Patent Number: 4,713,529

[45] Date of Patent: Dec. 15, 1987

[54] ELECTROCERAMIC HEATING DEVICES WITH WELDED LEADS

[75] Inventors: Lionel J. Melanson, Casco; Richard C. Watson, Sebago Lake, both of Me.

[73] Assignee: GTE Products Corporation, Stamford, Conn.

[21] Appl. No.: 906,875

[22] Filed: Sep. 15, 1986

[51] Int. Cl.[4] ..... H05B 3/44; H01C 1/144; B05D 5/12

[52] U.S. Cl. ..... 219/541; 219/240; 219/247; 219/256; 219/288; 219/290; 219/289; 338/308; 338/329; 427/58; 427/101

[58] Field of Search ..... 219/240, 247, 288, 89, 219/90, 256, 541; 338/329, 308; 427/58, 101, 88

[56] References Cited

U.S. PATENT DOCUMENTS

| | | | |
|---|---|---|---|
| 3,391,373 | 7/1968 | Altman | 338/308 |
| 4,174,513 | 11/1979 | Wellard | 338/312 |
| 4,570,150 | 2/1986 | Zandman et al. | 338/329 |

*Primary Examiner*—Clifford C. Shaw
*Assistant Examiner*—Gerald E. Preston
*Attorney, Agent, or Firm*—James Theodosopoulos

[57] ABSTRACT

An electroceramic heater including a pair of metallized electrodes disposed upon the sides of an electroceramic body and a pair of lead wires gap is welded to said heater. A specially sized copper pad is disposed between the lead wires and the electrodes.

7 Claims, 3 Drawing Figures

ELECTROCERAMIC HEATING DEVICES WITH WELDED LEADS

This invention relates to metallized electroceramic heating devices, and particularly to such devices having radially extending lead wires that have been attached to it through the use of gap-welding techniques.

BACKGROUND OF THE INVENTION

Electroceramic heating devices with metallized electrodes are generally made from doped barium titinate ceramics which have a sharp positive temperature coefficient of resistance. The ceramics are designed such that below a critical temperature, the resistance of the material remains at a low value and is essentially constant. When a particular temperature is reached, a crystalline phase change takes place in the ceramic and this change in crystalline structure is accompanied by a sharp increase in the resistance at the crystalline grain boundaries. The result of this crystalline change is an increase in the heater resistance of several orders of magnitude over a small temperature change. For example, barium titinate heaters with a room temperature resistance of 3.0 ohms can increase to 1,000 ohms or more during the crystalline phase change. The temperature at which the crystalline phase change takes place can be adjusted in the manufacturing process through the use of appropriate chemical additives and can attain temperatures as high as 300° C., and even higher.

Commonly, current is carried to the device by means of wires that are attached to the metallized coatings that form the electrodes on the barium titinate body. When using devices that obtain temperatures as high as 300° C., special solders or solder pastes are used, together with special fluxes. These special fluxes, may seriously harm the devices since they can impregnate the grain boundaries of the ceramic when the device is operated and cause detrimental changes to the resistivity of the heater. Moreover, when soldering techniques are used, quite frequently the device has to be preheated to receive the solder. This preheating takes a substantial amount of time in the manufacturing process and it is worthwhile to eliminate it.

While the soldering method is the most common way to attach leads to the heaters, other methods have also been used. Such methods include laser welding techniques which requires the use of extremely expensive laser equipment to produce a relative inexpensive product, and thus is not practical for the manufacture of many of the types of heaters envisioned by the present invention.

SUMMARY OF THE INVENTION

According to the present invention, we have discovered that parallel gap welding techniques can be used to attach the wires to electrodes which have been thermally coated on the body of an electroceramic heating device. Gap welding of wires to electrodes is achieved when a pair of spaced-apart electrodes is urged against lead wires that are laid upon the metallized surfaces which form the electrodes of the device. We have found that for the gap welding to be successful, close care must be paid to the thickness of metallized electrodes and provision must be made for an overcoat layer of a metal that is dissimilar to that of the metallized electrodes and is disposed between the lead wires and the metallized electrodes.

The heater of the present invention includes a pair of metallurgically coated electrodes, electrically insulated from each other, and disposed on either side of a substrate of an electroceramic material. The substrate is capable of producing heat upon application of current to the electrodes. Lead wires are welded to small pads of copper coated on the electrodes, the pads being of a predetermined shape and thickness. The lead wires extend outwardly from the body of the device and are gap welded to the metallized electrodes and the copper pads.

The metallized electrodes, in the preferred embodiment, are disposed inside of the perimeter of the body of the electroceramic material, whereby to form uncoated shoulders around the edges of the body and to provide electrical insulation of the electrodes from each other. The gap weld, as provided in the present invention, occurs at two locations on the length of each of the lead wires. We have found that for a good weld to be made between the metallized coatings and the lead wires, wires of steel that are clad with copper and coated with tin or nickel should be used. Pads of copper are disposed on the metallized coatings and beneath where the lead wires are to be attached. In this way, a copper to copper weld is made in the gap welding process, and an effective attachment of the wire to the device is made. The tin or nickel coating on the wire, we have found, prevents sticking of the gap-welding electrodes to the wire while the weld is being made. The quantities in the coating are insufficient to alloy significantly with the copper of the wire or the pads which would weaken the weld.

With the gap welding techniques of the present invention, the metallized ceramic device is held stationary in a fixture and the lead wire is placed on the copper pad that is coated on the metallized ceramic surface. The gap welder is urged against the lead wire and current is applied to heat the metals and form the weld. The partially fabricated device is then turned over and the process is repeated on the other side so that the leads are welded to each of the metallized surfaces.

DESCRIPTION OF THE PREFERRED EMBODIMENTS

Figure 1:
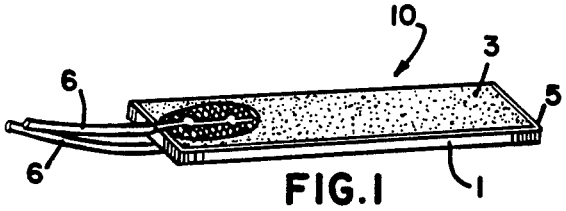
FIG. 1 is a perspective view of the heater of the present invention showing a metallized layer, the electroceramic that forms the body of the heater, the gap welded lead wires and the coated metal layer between the lead wires and the metallized layer.
Figure 2:
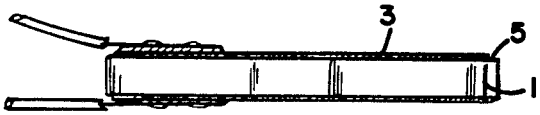
FIG. 2 is a side elevational view of the heater shown in FIG. 1.

Referring now to FIGS. 1 and 2, the electroceramic device or heater 10 has a thermally sprayed, metallized surface that forms the electrodes 3 which are disposed upon the ceramic substrate 1. The electrodes 3 are separated from each other by the substrate 1 and shoulders 5 which are disposed around the perimeter of the device 10. The device 10 is made in a flat shape and is formed, generally, of doped barium titanate ceramics which have a sharp positive temperature coefficient of resistance. The device 10 is designed such that below a critical temperature, the resistance of the ceramic substrate 1 remains at a low value and is essentially constant. When the ceramic's anomaly temperature is reached, a crystalline phase change takes place in the ceramic and this change in crystal structure is accompanied by the sharp increase in the resistance at the crystalline grain boundaries. The result of this crystalline change is an increase in the heater resistance of several orders of magnitude over a very small shift in temperature. The temperature at which the crystalline phase change takes place can be adjusted in the manufacturing process through the use of appropriate chemical dopents and can be varied between 50° C. and 300° C., and even higher. When energized with a suitable voltage by applying current to the electrodes an opposite sides of the device 10, the ceramic rapidly heats up to its predeterined operating or anomaly temperature and then "locks in" at this temperature.

This rapid heating is due to the initial low resistance of the ceramic which results in an internal high power of the heater. The "lock in" is due to the abrupt increase in resistance which causes generated power to be reduced until it equals dissipated power. At this point, thermal equilibrium is achieved and the device 10 self-regulates itself at the temperature.

The electrodes 3 are sprayed upon the substrate 1 by heating aluminium wire to a molten condition and then blowing molten droplets towards a bank of the substrates (appropriately masked around their perimeters so as to provide shoulders 5). The blown particles of molten aluminium condense upon the substrates to form coatings which are the electrodes 3.

A pad of copper 4, in the form of a coated layer, is dispersed on the metallized electrode layer 3 (preferably by spraying) and forms a base of attachment for the lead wires 6. The metallized aluminium layer forming electrode 3 is preferably 0.0002 to 0.01 inch thick, and applied by spraying the electroceramic substrate 1 with molten aluminium metal. The aluminium layer that is formed is sufficiently thick to thermally insulate the electroceramic substrate 1 from the weld material (sometimes called a weld nugget) and prevent damage. The pad of copper 4 can be applied by spray metallizing, and its thickness should be about one to three times greater than that of the aluminium electrode layer 3, generally between about 0.005 and 0.01 inch. The pad 4 provides for dissipation of the heat that is generated during the gap welding process, whereby the heat will not be concentrated exclusively in the area of the welding electrodes. In the preferred embodiment, the copper pad 4 is at least about one or two times as wide as the diameter of the lead wire 5, but no more then about six or eight times as wide. If the copper pad 4 is not sufficiently wide, a weldable thermal conductor will not be provided, while if it is too wide (when the electroceramic material becomes hot), we have found that the aluminium and copper coatings act together as if they were a bimetal (because of the differences in the coefficients of thermal expansion) and may pull away from the ceramic substrate as a single layer. While copper metal is the preferred material for the pad 4, we have found that copper based alloys such as phosphor-bronze and brass can be used also.

Figure 3:
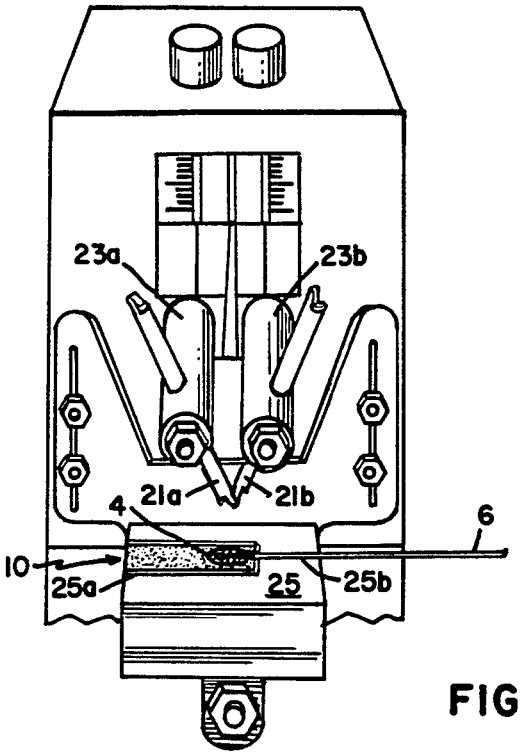
FIG. 3 is a perspective view of a gap welder that can be used to weld the lead wires to the metallized surfaces of the heater of the present invention.

Turning now to FIG. 3, a pair of electrodes 21*a* and 21*b* are shown disposed in a spaced-apart relationship to each other. The electrodes are held in a pair of electrically conductive clamps 23*a* and 23*b* which move vertically with respect to a cavity 25*a* that is disposed in an alignment fixture or jig 25. The cavity 25*a* holds the heater 10 with wire 6 disposed on a connecting, longitudinally extending cavity 25*b*. Prior to welding, the cavity 25*b* holds the wire 6 in a position where the electrodes 21*a* and 21*b* can engage it. Electrodes 21*a* and 21*b* travel with clamps 23*a* and 23*b* in a path normal to the heater 10 and wire 6 and will be urged against and into contact with wire 6 for a sufficient time for the weld to be formed. Current is passed through the wire 6 through electrodes 21*a* and 21*b* and sufficient heat is generated for the copper coating on wire 6 to weld itself to the copper of pad 4 thereby adhering the wire 6 to the heater 10. As mentioned previously, a tin coating on the steel-based, copper-clad wire prevents the wire 6 from sticking to the electrodes 21*a* and 21*b*. The coating of copper should be between 0.002 and 0.003 inch thick, which will provide an adequate thickness for the weld. Following the formation of the weld, the partially fabricated heated 10 is turned over and the gap welding procedure described above is repeated.

The heater 10 that is formed is quite unique in that there are two impressions on each of the lead wires that are welded to it. The weld is formed on the opposite side of the impressions and between them. We have found that the weld is quite strong and can withstand considerable pulling, even under the conditions that occur during use.

It is apparent that modifications and changes can be made within the spirit and scope of the present invention, but it is our intention, however, only to be limited by the scope of the appended claims.

As our invention, we claim:

1. An electroceramic heater comprising:

a pair of metallic coatings forming metallic electrodes, electrically insulated from each other and a body of electroceramic material disposed therebetween, said body being capable of prodcing heat upon application of current to electrodes; and a lead wire extending outwardly from each of the metallic electrodes; and pads comprising a layer of copper metal disposed between each lead wire and the respective metallic electrode; and said lead wires being welded to each of the respective electrodes by means of said pad, each of said lead wires having at least two impressions formed thereon, and said weld being formed between said impressions and between respective pad and lead wire.

2. The heater according to claim 1 wherein the metallic electrodes are disposed inside of the perimeter of said body whereby to form uncoated shoulders around the perimeter of said body and to provide electrical insulation of the electrodes from each other.

3. The heater according to claim 2 wherein the metallized electrodes are formed of aluminium, said aluminium being in a thickness of 0.001 to 0.010 inch.

4. The heater according to claim 1 wherein the pads are about one to three times greater than the thickness of the metallic coatings.

5. The heater according to claim 2 wherein the lead wire is formed of steel wire clad with 0.002 to 0.003 inch thick copper and coated with tin or nickel.

6. The heater according to claim 2 wherein the electrode is between 0.002 and 0.01 inch thick and the pad is between 0.005 and 0.01 inch thick.

7. The heater according to claim 5 wherein the pad is between 3 and 5 times as wide as the diameter of the lead wire.

* * * * *